US006345625B1

(12) United States Patent
Chew

(10) Patent No.: US 6,345,625 B1
(45) Date of Patent: Feb. 12, 2002

(54) FILTER FOR SECONDARY SMOKE AND SMOKING ARTICLES INCORPORATING THE SAME

(76) Inventor: Kar Eng Chew, 69 Jalan SS 22/12 Damansara Jaya, Petaling Jaya (MY), 47400

( * ) Notice: Subject to any disclaimer, the term of this patent is extended or adjusted under 35 U.S.C. 154(b) by 0 days.

(21) Appl. No.: 09/193,878

(22) Filed: Nov. 18, 1998

(30) Foreign Application Priority Data

Dec. 6, 1997 (MY) ..... PI 9705874
Jun. 24, 1998 (MY) ..... PI 9802880

(51) Int. Cl.[7] ..... A24D 1/04; A24F 1/20; A24F 1/02

(52) U.S. Cl. ..... 131/202; 131/205; 131/206; 131/201; 131/200; 131/212.1; 131/213; 131/215.1; 131/215.2; 131/216; 131/331; 131/187; 131/330

(58) Field of Search ..... 131/330, 200, 131/201, 202, 205, 206, 212.1, 213, 215.1, 215.2, 215.3, 340, 331, 329, 216, 175, 187

(56) References Cited

U.S. PATENT DOCUMENTS

| | | | |
|---|---|---|---|
| 3,220,418 | A | 11/1965 | Cohn |
| 3,533,414 | A | 10/1970 | Beam |

(List continued on next page.)

FOREIGN PATENT DOCUMENTS

| | | |
|---|---|---|
| AU | B1-19180/76 | 11/1976 |
| AU | B-56588/80 | 3/1980 |
| AU | B-69467/81 | 4/1981 |
| AU | B-84618/82 | 9/1981 |
| AU | B-79237/82 | 1/1982 |
| AU | B-19658/83 | 9/1982 |
| AU | B-28069/84 | 5/1984 |
| AU | B-57657/86 | 5/1986 |
| AU | B-25228/88 | 8/1988 |
| AU | B-34430/89 | 10/1988 |
| AU | B-48501/90 | 1/1990 |
| AU | B-50018/90 | 2/1990 |
| AU | B-57339/90 | 5/1990 |
| AU | B-57593/90 | 6/1990 |
| AU | B-57776/90 | 6/1990 |
| AU | A-76346/91 | 5/1991 |
| AU | B-25231/92 | 9/1992 |
| AU | B-25232/92 | 9/1992 |
| AU | A-62067/96 | 8/1996 |
| CA | 2104434 A | 2/1995 |
| EP | 0 059 042 A1 | 9/1982 |
| EP | 0 255 114 A1 | 2/1988 |
| EP | 0 432 927 A1 | 6/1991 |
| GB | 2 160 084 A | 12/1995 |
| GB | 2 282 314 A | 4/1996 |
| WO | WO 89/10070 | 11/1989 |
| WO | WO 95/02970 | 2/1995 |
| WO | WO 95/34226 | 12/1995 |
| WO | WO 96/41546 | 12/1996 |

*Primary Examiner*—James Derrington
*Assistant Examiner*—Dionne A. Walls
(74) *Attorney, Agent, or Firm*—Merchant & Gould P.C.

(57) ABSTRACT

Secondary smoke is harmful to passive smokers. A filter sleeve (1) comprises a sleeve (10) with a downstream portion (11) adapted for receiving inhale smoke into an inhalation flow path (13), an upstream portion (12) adapted for inhalation of said inhale smoke and for receiving exhale smoke into an exhalation flow path (14), filter means (15) provided along said exhalation flow path (14), and means (16) for checking reverse flow of ambient air through said exhalation flow path (14). A filter sheath (3) is adapted for overlaying a significant expanse of the sidestream smoke emission areas of a rod of smokable material (7), said filter sheath (3) is sufficiently porous and significantly unimpaired by combustion.

23 Claims, 6 Drawing Sheets

U.S. PATENT DOCUMENTS 3,632,384 A 1/1972 Saint-Pastou
3,830,244 A 8/1974 Luke
3,886,954 A 6/1975 Hannema et al.
4,119,105 A 10/1978 Owens, Jr.
4,187,862 A 2/1980 Cohn
4,200,114 A 4/1980 Waite
4,225,636 A 9/1980 Cline et al.
4,236,539 A 12/1980 Mosby, Jr.
4,254,782 A 3/1981 Ligeti
4,273,141 A 6/1981 Van Tilburg
4,273,142 A 6/1981 Swanson et al.
4,369,798 A 1/1983 Jackson
4,413,638 A 11/1983 Le
4,453,553 A 6/1984 Cohn
4,532,943 A 8/1985 Nichols et al.
4,570,646 A 2/1986 Herron
4,582,073 A 4/1986 Simkanich
4,616,664 A 10/1986 Chumney, Jr.
4,620,553 A 11/1986 Bale et al.
4,637,407 A 1/1987 Bonanno et al.
4,685,477 A 8/1987 Valdez
4,773,435 A 9/1988 Ikeda et al.
4,790,332 A 12/1988 Wallace
4,807,646 A 2/1989 Sahar
4,907,603 A 3/1990 Chambers
4,922,931 A 5/1990 Nare et al.
4,955,397 A 9/1990 Johnson et al.
4,993,435 A 2/1991 McCann
4,998,541 A 3/1991 Perfetti et al.
5,050,622 A 9/1991 Raker et al.
5,058,608 A 10/1991 Henning et al.
5,060,674 A 10/1991 Brown et al.
5,060,675 A 10/1991 Milford et al.
5,353,814 A 10/1994 Martin
5,360,023 A 11/1994 Blakley et al.
5,388,595 A 2/1995 Shafer
5,450,862 A 9/1995 Baldwin et al.
5,495,859 A 3/1996 Bowen et al.
5,501,234 A 3/1996 Hyre
5,529,078 A 6/1996 Rehder et al.

FILTER FOR SECONDARY SMOKE AND SMOKING ARTICLES INCORPORATING THE SAME

TECHNICAL FIELD

The present invention relates to a filter for use with a smoking article for the filtration of secondary smoke. Also contemplated are smoking articles incorporating such filter.

BACKGROUND ART

The term "smoke" herein used may encompass visible smoke, particulate matter in smoke, noxious gases, vapours, aerosols, or the like, produced by a smoking article. "Smoking article" may encompass a cigarette (including less smoke cigarettes, coaxial cigarettes and the like), cigar, simulated smoking article, pipe, or the like. "Rod of smokable material" may encompass a cigarette, cigar or the like. "Combustion" may encompass smouldering.

Secondary smoke comprises of smoke that is exhaled by a smoker and/or sidestream smoke which is emitted into the ambient environment from the burning portion of a smoking article. Secondary smoke cause considerable discomfort and harm to passive smokers. Past efforts to solve this problem have not been very successful. The prior art includes cigarette filter tips, tubular cigarette holders with filter elements for filtering mainstream smoke, sheaths formed from cigarette wrapping materials, coaxial filter cigarettes, and various hand held smoke filtration devices.

Cigarette filter tips have been used with a tobacco column for filtering inhale smoke. Examples of cigarette filter tips include those known in AU-B-19,180/76; AU-B-56,588/80; AU-B-69,467/81; AU-B-79,237/82; AU-B-19,658/83; AU-B-57,776/90; AU-A-62,067/96; EP 0,059,042 A1; EP 0,255,114 A1; US Pat. Nos. 3,533,414; 3,830,244; 4,119,105; 4,254,782; 4,273,141; 4,273,142; 4,532,943; 4,582,073; 4,616,664; 5,058,608; and 5,360,023.

Cigarette filter tips are not intended for filtering exhale smoke. With respect to the filtration of exhale smoke, cigarette filter tips may have one or more of the following drawbacks:

a) the filter materials used in filter tips allow a considerable amount of smoke to pass therethrough so that a smoker may fulfill his desire for smoke. Said filter materials may not filter exhale smoke to be substantially smoke-free.

b) valves provided in some filter tips may open for the drawing of inhale smoke and/or ambient air. However said valves may not substantially check the inflow of said ambient air through said filter tips upon inhalation and allow a considerably high rate of exhale flow therethrough that may be expected if said filter tips are to be used to filter exhale smoke.

In addition, the filter materials used in filter tips may have a high resistance to exhale flow, thereby making exhalation into such materials almost impossible. Further, ventilation holes or vents provided in some filter tips for the dilution of inhale smoke may be too minute in size for allowing a high rate of exhale flow therethrough that may be expected if said filter tips are to be used for filtering exhale smoke. In some cases, filter materials may not be provided along the ventilation vents for filtering smoke.

AU-B-84618/82, in particular, disclosed a chambered filter for a cigarette comprising a first longitudinally extending cylindrical chamber and a second longitudinally extending cylindrical chamber disposed within the first chamber. A porous filter rod may be provided in the space between the walls of the first and second chambers, said porous filter rod allows ambient air to be drawn for the dilution of inhale smoke. An air pervious tipping paper may be used to circumscribe said porous filter rod. In this article, it may be noted that (a) the second chamber has an air impervious wall whereby smoke exhaled into said second chamber may not access the filter rod, and (b) the article does not provide any means for substantially checking the flow of ambient air through the filter rod during inhalation. Also, the filter rod may not allow a considerably high rate of exhale flow therethrough.

U.S. Pat. No. 4,955,397 disclosed a cigarette having a filter plug located at one end of said cigarette. Said filter plug has a cylindrical passageway coaxial therethrough, said passageway communicates only with the tobacco rod, whereas said filter plug communicates with a cylinder of carbon fuel surrounding the tobacco rod and filters flows from said carbon fuel. However, it may be noted that this article does not provide any means for substantially checking the flow of ambient air through the filter plug during inhalation, and it may not allow a high rate of exhale flow therethrough during exhalation.

U.S. Pat. No. 4,620,553 disclosed a filter for a smoking article employing a valve assembly resiliently biased towards a first open position for allowing the inflow of ambient air, said valve assembly being displaceable towards a second closed position to cut off ambient air when a particular suction pressure is exceeded. AU-B-57657/86 disclosed an insert interposed between a tobacco column and a filter tip. Said insert has a valve member for admitting ambient air into the inhale flow upon a weak suction, whereas ambient air is cut off upon a strong suction. In both articles it may be noted that (a) the filter materials are intended to allow a substantial amount of smoke to pass through for the purpose of smoking. Such filter materials may not filter exhale smoke to be substantially smoke-free, and (b) the valve members may not substantially check the reverse flow of ambient air through the articles and they may not allow a high rate of exhale flow therethrough.

Furthermore, the insert of AU-B-57657/86 does not contain any filter materials for filtering exhale smoke. Also, it is not stated the valve member may allow passage of exhale smoke through said insert.

Tubular cigarette holders with filter elements have been used with filter and non filter cigarettes for filtering mainstream inhale smoke. In use, the mouth end of a cigarette is attached to one open end of a tubular cigarette holder wherein filter elements provided in the cigarette holder may filter any smoke drawn through said holder. With respect to the filtration of exhale smoke, however, such cigarette holders may have one or more of the following drawbacks:

a) the filter materials used in cigarette holders allow a substantial amount of smoke to pass through such as is intended to satisfy a smoker's desire for smoking. Such filter materials may not filter exhale smoke to be substantially smoke-free.

b) the filter materials used in cigarette holders may allow for easy inhalation, but such materials are resistant to the passage of exhale smoke.

c) no provision may be made for the discharge of exhale flow from a cigarette holder. Once a cigarette is attached to an open end of a holder, said end would be blocked by said cigarette. When the opposite end of said holder is inserted into the mouth, it may be impossible to exhale into said holder and for any smoke trapped inside said holder to be discharged into the ambient environment.

U.S. Pat. No. 4,369,798, in particular, disclosed a combination cigarette holder and cigarette smoke catcher comprising a cigarette holder body terminating at one end in a hollow mouthpiece, said mouthpiece communicates to a pair of parallel cylindrical passages provided within the holder body. One passage holds the unlit end of a cigarette while the other passage holds a smoke catcher cartridge for filtering exhale smoke blown into said mouthpiece. Said cigarette holder, nevertheless, suffers from the following drawbacks, (a) the holder body employs a valve means in the passage for holding a cigarette, said valve means is provided for allowing the flow of inhale smoke. In use however, the action of the valve means actually impedes the inhale flow and causes an undesireable increase in resistance to inhalation, (b) the flow of exhale smoke through the passage holding the cigarette may be substantially blocked by said cigarette in communication. Said valve means is therefore not essential for the performance of the holder body, (c) said valve means adds to the weight, size, cost and manufacturing complexity of the cigarette holder, (d) the passage for holding the smoke catcher filter opens at the other end to the exterior of said body remote from the mouthpiece. This forces exhale flow to travel a long distance through said passage and through the length of the smoke catcher filter cartridge before reaching the ambient environment. This has the effect of increasing resistance to exhalation and adding unnecessarily to the size and weight of the holder body, (e) the smoke receiving surface of the smoke catcher filter cartridge is limited by the radial cross-section of the second passage. A small cross-section may limit the efficiency of filtration while a large cross-section may add considerably to the circumference of the holder and deprive it of elegance, (f) the holder is not disposable in nature, but employs a replaceable smoke catcher filter cartridge. Loading and unloading of cigarettes and cartridges is an inconvenience, (g) the holder is presented as a stumpy, generally rectangular body. The considerably large circumference of the holder body renders it unsuitable for packaging into a cigarette box with a cigarette in communication in a pre-packed form, (h) the holder body is not coaxially aligned in communication with a cigarette. It lacks a streamline profile with a cigarette, which profile may be desirable to a discerning smoker, and (i) the holder body comprises of hinged body halves which require some effort in loading and unloading of cigarettes and filter cartridges.

Further, a number of patents have been filed on cigarette wrapping materials. Examples of wrapping materials include those disclosed in AU-B-28,069/84; AU-B-25,228/88; AU-B-34,430/89; AU-B-50,018/90; AU-B-57,339/90; AU-B-57,593/90; AU-B-25,231/92; AU-B-25,232/92; EUROPEAN Pat 90,312,761.1; PCT/US88/03,416; UK Pat. 8,514,605; U.S. Pat. Nos. 3,632,384; 4,187,862; 4,225,636; 4,453,553; 4,998,541; 5,050,622; 5,060,674; 5,060,675; and 5,450,862.

Wrapping materials are used to circumscribe a rod of smokable material. Some wrappers may be fire resistant with respect to preventing the lit tobacco materials from igniting objects coming into contact with the cigarette. In some cigarettes, more than one layer of wrapping materials may be used. Sheaths formed from such wrapping materials may have one or more of the following drawbacks:

a) they may lack a filtering capability for substantially filtering smoke before release into the ambient environment.

b) they may lack porosity to ambient air necessary for the sustenance of combustion of the smokable materials therein contained.

c) they may be significantly impaired or destroyed by the combustion of the smokable materials therein contained.

AU-B-76346/91 disclosed a method of producing a non-burning wrapper for use with smoking products. U.S. Pat. Nos. 3,220,418 and 3,886,954 disclosed cigarettes having an essentially non-combustible sheath which retains ashes and shields the burning zone of a cigarette. These prior arts, however, lack a filtration capability for sidestream smoke filtration.

A number of coaxial filter cigarettes have been proposed which may resemble a sheath laid over a rod of smokable material. These cigarettes may have one or more of the following drawbacks:

a) the sheath may not have a filtration capability, b) the sheath may lack the porosity necessary for combustion sustenance, and c) the sheath may be significantly impaired or destroyed by combustion of the smokable materials therein contained.

AU-B-48501/90, in particular, disclosed a coaxial filter cigarette having an inner core of tobacco material, a wrapper surrounding the inner core, an outer shell of a tobacco and/or non-tobacco material coaxially surrounding the inner core and its wrapper, and an outer wrapper surrounding the outer shell as well as a filter portion which substantially reduces the smoke particles originating from the inner core whereas the aerosol produced in the outer shell is only slightly or not influenced at all by the filter portion. The article of AU-B-48501/90 may reduce sidestream smoke emission through shielding by the outer shell. However, it may be noted that (a) neither the outer shell nor the outer wrapper is specifically mentioned to contain any filter material. On the contrary, the outer shell comprises of materials intended for releasing aerosol and/or vapour for smoking, (b) the outer shell is significantly permeable to sidestream smoke and allows the generated smoke to pass through and be inhaled as mainstream smoke, and (c) the article uses a cigarette paper as an outer wrapper for surrounding the outer shell, said cigarette paper is either air impermeable or has a very low air permeability of less that 25 ISO units. Such low air permeability may not allow for sustenence of combustion of the tobacco materials contained therein unless said outer wrapper is significantly destroyed during the combustion process.

U.S. Pat. No. 4,955,397 disclosed a cigarette including a tobacco rod circumscribed by a metal foil wrapper and having a cylinder of carbon fuel surrounding the metal foil wrapper tobacco rod. An air permeable outer wrapper circumscribes the cylinder of carbon fuel. A filter plug is located at one end of the cigarette. It may be noted that in this article, the outer wrapper circumscribing the cylinder of carbon fuel is not made with a filter material and may therefore not filter sidestream smoke.

Various accessory smoke filtration devices have been proposed. U.S. Pat. No. 5,353,814 described a pocket sized cigarette smoke cleansing smoking device comprising an elongated tubular housing for receiving a cigarette, said housing having an inhalation-exhalation mouthpiece at one end connected by a separate longitudinal passageway to a filter at the opposite end of the device, said filter receives both sidestream smoke and exhale smoke for filtration. It is believed that this device does not affect the novelty of the present invention because (a) passage of exhale smoke through the device is assisted by a motor and fan assembly, (b) the cigarette receiving chamber does not overlay the cigarette, and (c) the wall of the cigarette receiving chamber is not air permeable. Other drawbacks of this device include considerable thickness and weight, noise and vibration from the motor and fan assembly, need for a power source, a high cost, need for manual adjustment of a switch to alternate between inhalation and exhalation, excessive space used up by the exhalation passageway, and the small size of the smoke receiving surface of the filter which is severely limited by the internal diameter of the device.

PCT/GB95/01299 and U.S. Pat. No. 4,685,477 described protective filter sheaths for surrounding a cigarette. In both articles, the filter walls are not overlaid on a cigarette, but are substantially spaced from a cigarette by an air space. The articles may thus considerably increase the circumferential thickness to be handled by a smoker by virtue of the space provided between said cigarette and the filter wall.

PCT/BE96/00057 described a smoker's requisite consisting of a rigid sleeve that may be slid along a lit cigarette and momentarily positioned over the smouldering tip thereof then withdrawn to enable the smoker to take a puff from the opposite end in a conventional manner. One drawback of this article is that it covers only the portion about the burning tip of a cigarette. It requires a smoker's constant involvement to intermitently slip it on and off in response to inhalation, and to slide it along the length of a cigarette in response to the burning of the cigarette. The article is also likely to be thick and heavy, and may jeopardize the weight distribution of a cigarette.

U.S. Pat. No. 4,570,646 described a tobacco receiving and holding structure having an air inlet and a smoke outlet, means associated with said tobacco holding structure for burning tobacco material contained therein, and means for limiting and controlling the burning rate consisting of a normally closed valve which admits external air into the tobacco containing chamber in response to a smoker's drawing. It may be noted that (a) this article relies on a separate and bulky accessory device for the filtration of exhale smoke, (b) the wall of the tobacco chamber does not overlay the cigarette, and (c) the article is not air permeable but relies on a ventilation valve to admit ambient air into the tobacco chamber. Said ventilation valve admits ambient air only upon inhalation, thus forces a smoker to inhale almost continuously to sustain combustion, whereas smokers often prefer to space out inhalation at a leisurely pace.

U.S. Pat. No. 5,495,859 disclosed a tubular filter for use in a smoker's accessory for filtering cigarette smoke. Said filter has an inlet end for directing sidestream smoke or exhale smoke into an end of an inner elongate chamber within said tubular filter. In this article, it may be noted that said tubular filter may not overlay a cigarette. On the contrary, sidestream smoke is generated outside the elongate chamber and is directed into said inner elongate chamber for filtration.

There are various other accessory filtration devices for secondary smoke. Examples include CA Pat. 2,104,434-A; GB 2,282,314 A; U.S. Pat. Nos. 4,200,114; 4,236,539; 4,413,638; 4,637,407; 4,773,435; 4,790,332; 4,807,646; 4,907,603; and 4,993,435. These filtration devices may have one or more of the following drawbacks:

a) they may require manual loading and unloading of cigarettes or cigars.

b) they are cumbersome and inconvenient to carry about.

c) they may have separate sections for inhalation and exhalation, thus making them difficult to use.

d) they may be designed to accept more than one cigarette, thus require constant monitoring and/or maintenance.

e) they may be rendered impotent when users exceed the prescribed filtration limits.

f) when the filtration limits are about to be reached, smokers may have to carry an extra set of new devices or filter cartridges as handy replacement.

g) they may employ a fan and motor assembly which would cause noise and vibration.

None of the prior arts have been greatly successful in the market place. Smokers' preference is complex and their rejection of various drawbacks of the prior art may be central to commercial failure. Secondary smoke thus continues to affect an innumerable number of non-smokers daily. This invention therefore attempts to provide a better solution to the problem of secondary smoke pollution, if it is possible, that the various drawbacks elaborated above may be eliminated or lessened.

SUMMARY OF INVENTION

The present invention provides a filter of enhanced slimness for filtering secondary smoke. In one embodiment, the invention provides a filter sleeve for filtering exhale smoke comprising a sleeve with a downstream portion adapted for communicating with a smoking article to receive inhale smoke from said smoking article;

an upstream portion adapted for inhalation of said inhale smoke and for receiving of exhale smoke;

at least one inhalation flow path from said downstream portion to said upstream portion, said inhalation flow path is provided for channelling of said inhale smoke for inhalation through said upstream portion;

at least one exhalation flow path extending from said upstream portion to at least one exit into the ambient environment whereby exhale smoke received into said upstream portion is channelled through said exhalation flow path for filtration and discharge of filtered air into the ambient environment;

filter means provided along at least one exhalation flow path, said filter means is provided for said filtration of received exhale smoke to produce filtered air, said filter means is of such efficiency as to render said filtered air substantially smoke-free;

wherein the discharge of said filtered air into the ambient environment is significantly unimpeded by said smoking article when said smoking article is in flow communication with said downstream portion of the sleeve;

and means for substantially checking the reverse flow of ambient air through said exhalation flow path, said means allow a considerably high rate of exhale flow to pass through said exhalation flow path.

In another embodiment, the present invention provides a filter sheath for filtering sidestream smoke comprising a sheath adapted for overlaying a significant expanse of the sidestream smoke emission areas of a rod of smokable material;

said sheath consists significantly of a filter material that is substantially impermeable to sidestream smoke;

said sheath is of sufficient porosity to air to enable sustenance of combustion of said rod of smokable material;

and said sheath is significantly unimpaired by the combustion of said rod of smokable material.

The filter sleeve and filter sheath of the present invention may provide for enhanced slimness in an article for the filtration of secondary smoke. Other possible advantages include (a) reduced weight, (b) suitability for mass production, (c) suitability for assembly in a mass production facility to provide a disposable pre-packed form of the filter sleeve and/or filter sheath in communication with a cigarette or cigar, (d) suitability for packaging in communication with a cigarette or cigar into a minimally altered cigarette or cigar box, (e) zero maintenance, (f) easy handling and use, (g) lower cost compared to existing hand held filters for secondary smoke, and (h) lesser distortion to taste and other characteristics of the inhale smoke compared to less smoke cigarettes and vapour or aerosol emitting simulated smoking articles of the prior art. Yet other advantages of the filter sleeve and filter sheath of the present invention will be readily apparent from the following sections on detailed description of the invention, specific examples and claims.

The filter sleeve may be adapted for use with a smoking article such as a cigarette (encompasses conventional cigarettes, less smoke cigarettes, coaxial cigarettes, and the like), cigar, simulated smoking article, pipe, or the like.

At least one downstream inlet may be provided at the downstream portion of the sleeve, said downstream inlet may be provided for the receiving of inhale smoke into the inhalation flow path. Said downstream inlet may be provided in the downstream end of the sleeve and/or in the wall of the sleeve toward the downstream end. When the downstream inlet of the sleeve is in flow communication with a smoking article, smoke from said smoking article may be drawn into said downstream inlet, move along the inhalation flow path, and out through the upstream portion of said sleeve for inhalation.

The upstream portion may receive exhale smoke at a considerably high rate of exhale flow.

At least one upstream outlet may be provided at the upstream portion of the sleeve, whereby inhale smoke channelled through the inhalation flow path may be inhaled through said upstream outlet. The upstream outlet may be provided in the upstream end of the sleeve and/or in the wall of the sleeve toward the upstream end.

At least one upstream inlet may be provided at the upstream portion of the sleeve, said upstream inlet may be provided for the receiving of exhale smoke into said upstream portion and the exhalation flow path. The upstream inlet may be provided in the upstream end of the sleeve and/or in the wall of the sleeve toward the upstream end. The upstream inlet may allow a considerably high rate of exhale flow to pass therethrough. Said upstream inlet may preferably provide a total opening size of at least 4 sq. mm. for receiving exhale smoke.

At least one upstream outlet may be provided at the upstream portion of the sleeve for the inhalation through said upstream outlet of inhale smoke channelled through said inhalation flow path, and at least one upstream inlet may be provided at the upstream portion for the receiving of exhale smoke into said upstream portion and into the exhalation flow path, whereby said upstream outlet and said upstream inlet may coincide. The upstream outlet-cum-inlet may allow a smoker to inhale from and exhale into the sleeve without any adjustment of the sleeve.

At least one inhalation flow path may connect at least one downstream inlet to at least one upstream outlet of the sleeve. In one example, the inhalation flow path may be defined by the elongate hollow inside the sleeve.

The exhalation flow path may exit the sleeve through the sleeve wall.

The exhalation flow path may allot a considerably high rate of exhale flow to pass therethrough so that exhalation into and through said exhalation flow path may be made easy. In one embodiment, the exhalation flow path may be defined by the elongate hollow inside the sleeve wherein exhale smoke may flow longitudinally along said hollow and exit the sleeve through the sleeve wall (side-wall) and/or openings in the peripheral regions of the downstream end of said sleeve.

The inhalation flow path and the exhalation flow path may coincide in part or in whole. In one example, a part of the exhalation flow path may coincide with a part of the inhalation flow path. FIG. 2 below shows one embodiment of such an example. In a second example, a part of the exhalation flow path may coincide with the whole of the inhalation flow path. This will become obvious from the description of FIG. 4 below. In a third example, the whole of the exhalation flow path may coincide with the whole of the inhalation flow path, as when the sleeve wall is made of porous activated carbon paper wherein a thin plastic film may be laid over said porous activated carbon paper. Said plastic film may be punched to achieve apertures and flaps, said flaps may move outwardly away from the sleeve to open said apertures. When the downstream end of the sleeve is in communication with a smoking article, exhale smoke blown into the upstream open end of the sleeve may move along the elongate hollow of said sleeve whereby the flaps may open to allow exhale flow to exit the sleeve through said apertures. When suction is applied on the upstream open end of the sleeve, the flaps may close and inhale flow may move through said same elongate hollow. In one embodiment, the porous activated carbon paper may overlay an inner sleeve made of thin film, said inner sleeve may have apertures corresponding to the apertures and flaps of the outer plastic film whereby inhale smoke flowing along the elongate hollow of said inner sleeve may be substantially insulated from the porous activated carbon paper so that the taste of said inhale smoke may not be significantly affected by said porous activated carbon paper. The use of substantially the whole space of the elongate hollow of the sleeve reduces resistance to inhalation and exhalation, thereby making this embodiment suitable for use with a rod of smokable material having a relatively small external circumference.

The filter means may comprise of filter materials embodied in at least a portion of the wall of the sleeve wherein exhale smoke channelled through the exhalation flow path may be filtered transversely through said filter materials.

In one example, a filter sleeve may be adapted for use with a rod of smokable material having a large radial cross-section such as a cigar or a tobacco pipe wherein the filter means of the sleeve may comprise of a filter plug held inside an exhalation flow path of the sleeve, said filter plug may be of sufficient radial cross-section and low resistance to exhale flow whereby said sleeve may have a low resistance to exhalation.

The filter means be of such efficiency as to render the filtered air substantially smoke-free so that nearby non-smoking persons may enjoy a substantially smoke-free environment.

The filter means may allow a considerably high rate of exhale flow to pass therethrough. This may be achieved, for example, by employing a filter material with a low resistance to exhalation or by providing a large smoke receiving and filtration surface and/or a short distance of travel through the filter material, as for example, when the exhale smoke is channelled transversely through a porous filter material forming a substantial portion of a reasonably thin sleeve wall.

The filter means may be practically non-replaceable. For example, it may not employ a replaceable filter cartridge or any filter material that may be selectively replaced while continuing the use of other parts of the sleeve for their intended purposes. In one embodiment, a sleeve with a non-replaceable filter component may be provided integrally with a cigarette or cigar whereby said sleeve together with its filter component may suitably be discarded after consumption of said cigarette or cigar. In another embodiment, a filter sleeve may be provided separately whereby a smoker may personally attach said filter sleeve to a smoking article. Such a sleeve may employ a long-lasting non-replaceable filter component whereby said filter sleeve may be used to filter one or more smoking articles before said filter sleeve together with its filter component is discarded.

The filter means may comprise of at least one layer of filter materials. In one example, the filter means may comprise of one layer for filtering particulate matter and another layer for filtering gaseous components. The filter materials may be embodied in a porous host material such as a polymeric or ceramic or composite material. In one embodiment, the filter means may comprise of activated carbon porous paper or fabric forming the wall of the sleeve, which material may be easily biodegradable.

The filter means may employ materials conventionally used for filtering particulate matter, vapour and/or gas phase components of tobacco smoke. In one example, the filter material may comprise of an adsorbent for physical adsorption wherein exhale smoke may be bonded to the filter material by intermolecular attraction. The adsorbent may comprise of one or more in combination of Fuller's earths, activated clays, bauxite, alumina, bone char, decolorizing carbons, gas-adsorbent carbon, molecular-screening activated carbon, synthetic polymeric adsorbents, silica gel, or molecular sieves. Some prior art on suitable activated carbon filter materials are disclosed in a later part of this section.

The filter means may comprise of additives for chemisorption of exhale smoke wherein said exhale smoke may interact chemically with said additives. Sorption methods taught in the various prior arts on sidestream reducing cigarette wrapping materials and accessory smoke filtration devices may be adapted in the filter sleeve of the present invention.

In another example, the filter means may comprise of at least one electrically charge/discharge ion exchange medium.

The sleeve may include an outer wrapper, preferably air permeable, which may be useful to conceal the filter materials used, prevent the dropping of black dust from activated carbon materials, or improve the appearance and feel of the article.

Discharge of filtered air into the ambient environment may be provided through the wall of the sleeve and/or through the downstream end of the sleeve. In one embodiment, the filter means may comprise of filter materials embodied in the wall of the sleeve. When the downstream end of the sleeve is substantially blocked by a smoking article in communication with said downstream end, exhale smoke blown into the upstream end of the sleeve may move along the elongate hollow of the sleeve and be filtered transversely through the filter materials embodied in the wall of the sleeve whereby the resulting filtered air is discharged directly into the ambient environment. In another embodiment, an inner sleeve may be provided substantially coaxially inside an outer sleeve, said inner sleeve has a closed downstream end. A smoking article may be engaged to the downstream end in flow communication with the outer sleeve. Filter materials disposed within the inner sleeve produces filtered air when exhale smoke is blown into the upstream open end of said inner sleeve, wherein said filtered air may be discharged via tubular protruberances connecting a downstream section of said inner sleeve to openings in the wall of the outer sleeve. In a third embodiment, longitudinal grooves provided on the inside wall of a downstream portion of a sleeve may be transformed into exhalation flow paths for the discharge of filtered air when a smoking article is inserted into and held within said downstream portion of the sleeve.

The means for substantially checking the reverse flow of ambient air through the exhalation flow path may totally stop the reverse flow of ambient air through said exhalation flow path or allow a predetermined amount of ambient air to flow through said exhalation flow path for the dilution of inhale smoke. In one embodiment, an inhalation flow path and an exhalation flow path may both be in flow communication with an upstream opening of the sleeve, wherein a valve assembly provided along said exhalation flow path may allow a predetermined amount of ambient air to pass through said exhalation flow path so that inhale smoke flowing through said inhalation flow path may be diluted before reaching the mouth of a smoker.

The means for substantially checking the reverse flow of ambient air through the exhalation flow path may comprise of a valve system provided along said exhalation flow path.

The means for substantially checking the reverse flow of ambient air through the exhalation flow path may comprise of a valve system provided outside the sleeve wherein said valve system may be adapted for cooperating with said exhalation flow path for substantially checking the reverse flow of ambient air through said exhalation flow path. For example, a valve assembly may be provided along a through-way within a tobacco column, filter tip or an insert, said valve assembly may be connected in flow communication with the exhalation flow path of the filter sleeve when said tobacco column, filter tip or insert is in communication with the downstream portion of the filter sleeve.

The valve assembly for use as the means for substantially checking the reverse flow of ambient air through the exhalation flow path may be adapted from any existing valve system. The movable valve member may be resiliently biased towards a closed position or close through ionic or electrostatic attraction, magnetic attraction, or pneumatic pressure. Where desirable, at least one movable valve member may be adapted to close incompletely so that a certain amount of ambient air may be permitted to enter the sleeve through said valve system for dilution of the inhale smoke when the sleeve is in flow communication with a smoking article. In addition or alternatively, holes may be provided in one or more of the valve members or wall of the sleeve or downstream end of the sleeve for introducing ambient air into the inhale flow so that the inhale smoke may be diluted. The sizes and quantity of said holes may be such as to disallow too much unfiltered exhale flows to escape into the ambient environment. Preferably, said holes may be provided downstream of a valve system provided along the inhalation flow path for checking exhale flow so that exhale smoke may not exit the sleeve through said holes. The holes may be distributed in any conventional manner at the preferred regions of the sleeve.

In one example, said means for substantially checking the reverse flow of ambient air through the exhalation flow path may reside in the special construction of the upstream portion of the sleeve whereby an upstream outlet in communication with an inhalation flow path may be sufficiently distinguished from an upstream inlet in communication with an exhalation flow path so that said upstream outlet may be drawn without substantially drawing on said upstream inlet.

In one embodiment, the upstream portion of the sleeve may comprise of an inner tube provided coaxially within an outer tube so that the upstream end of the inner tube protrudes out of the upstream end of the outer tube. The elongate hollow of the inner tube may then define an inhalation flow path for drawing inhale smoke. The space between the outside wall of the inner tube and the inside wall of the outer tube may then define an exhalation flow path for channelling exhale flow. In use, a smoker may close his lips on the protruding upstream open end of the inner tube to draw inhale smoke, and then adjust his lips to close on the shorter outer tube to exhale smoke back into the filter sleeve for filtration. Exhale smoke may not substantially enter the inhalation flow path since such a route may be substantially blocked by the filter tip or tobacco column of a smoking article in communication.

The upstream portion through the upstream inlet, the exhalation flow path, the filter means and the means for checking the reverse flow of ambient air through said exhalation flow path, may allow a considerably high rate of exhale flow to pass therethrough whereby a smoker may exhale with considerable ease into and through the filter sleeve. In addition, it may minimize the pressure of any reverse flow of exhale smoke through the inhalation flow path so that said reverse flow may be sufficiently blocked by a smoking article in communication with the downstream portion of said filter sleeve.

It is preferable that the sleeve be suitably rigid to allow for more robust handling. Where the wall of the sleeve lacks rigidity, rigid support may be provided, for example, through a supporting layer, mesh, ribs or the like.

A filter plug for filtering inhale smoke may be provided along the inhalation flow path. Said filter plug may be provided as a supplement or substitute for the filter tip of a smoking article or as an addition when the filter sleeve is to be used with a non-filter smoking article.

The filter may comprise filter materials embodied in at least a portion of wall and assembly may be provided along the inhalation flow path or outside the sleeve, said valve assembly may be adapted for cooperating with said inhalation flow path to allow inhale smoke to pass through said inhalation flow path but substantially prevent exhale flow from passing through said inhalation flow path. In one embodiment, a valve assembly may be provided along a through-way within a tobacco column, filter tip or an insert whereby said valve assembly may be connected in flow communication with the inhalation flow path of the filter sleeve when said tobacco column, filter tip or insert is in communication with the downstream portion of the filter sleeve.

Additionally or alternatively, a double action valve assembly may be adapted for oppositely opening and closing the inhalation flow path and exhalation flow path of the sleeve to determine the direction and desired mix of fluid flow therethrough.

The sleeve may have an external circumference not significantly larger than that of the rod of a smoking article. The rod of a smoking article may encompass the stem of a tobacco pipe. Preferably, the external circumference of the sleeve may be the same or similar to that of the rod of a smoking article so that the sleeve in communication with said smoking article may provide a streamline profile and appear as a natural extension of said smoking article. Used with a smoking article having a rod of large external circumference, the sleeve may appropriately have a smaller external circumference or taper toward the mouth-end.

The filter sleeve may be adapted for substantial coaxial alignment in communication with the rod of a smoking article. When provided in communication, the respective communicating portions of the filter sleeve and the smoking article may be circumscribed with wrapping material.

Flow communication between the filter sleeve and a smoking article may be achieved in any conventional manner. In one embodiment, flow communication between the downstream portion of the sleeve and the smoking article may be provided through a tubular intermediary linking said downstream portion of the sleeve to the mainstream smoke outlet of said smoking article. In another embodiment, the mouth end of a cigarette may abut or mate into the downstream inlet of the filter sleeve.

The upstream portion of the sleeve may be circumscribed with wrapping material and/or tipping material. Said wrapping material and/or tipping material may be air permeable or air impermeable in any conventional manner. Preferably the wrapping material and/or tipping material may not cover any upstream outlet or inlet.

The filter sleeve may incorporate any one or more in combination of the features elaborated above wherein the downstream portion of the sleeve may be provided in flow communication with the mainstream smoke outlet of a smoking article whereby one or more of such filter sleeve with a smoking article may be in a pre-packed form. Such a pre-packed form may relieve a smoker of the task of connecting a smoking article to a filter sleeve.

The filter sheath of the present invention may be used with a rod of smokable material such as a cigarette (encompasses less smoke cigarettes and coaxial cigarettes), cigar, simulated smoking article, or the like.

The sheath may be adapted for overlaying a significant expanse of the sidestream smoke emission areas of a rod of smokable material. This may encompass a sheath adapted for overlaying all of the sidestream smoke emission areas of a rod of smokable material. In a conventional cigarette or cigar, the combustible surfaces of the cigarette or cigar may constitute the sidestream smoke emission areas of said cigarette or cigar. With a rod of smokable material which has an unlevel external surface about its sidestream smoke emission areas (such as a cigarette or cigar circumscribed with a pimpled wrapping paper), the sheath may overlay the higher surfaces of said sidestream smoke emission areas whereby the lower surfaces may be significantly confined by said sheath so that sidestream smoke emitted through said lower surfaces may still be substantially filtered through said sheath. Preferably, a smoker may not need to intermitently adjust the sheath during the process of smoking.

A significant portion or even the whole of the sheath may be made of a filter material that is substantially impermeable to sidestream smoke.

The filter material of the sheath may comprise of an adsorbent for physical adsorption wherein sidestream smoke may be bonded to the filter material by intermolecular attraction. The adsorbent may comprise of one or more in combination of Fuller's earths, activated clays, bauxite, alumina, bone char, decolorizing carbons, gas-adsorbent carbon, molecular-screening activated carbon, synthetic polymeric adsorbents, silica gel, or molecular sieves. In one embodiment, the filter material may comprise significantly of activated carbon.

In another example, the filter material of the sheath may comprise of additives for chemisorption of sidestream smoke wherein the sidestream smoke may interact chemically with said additives. Sorption methods taught in the various prior arts on sidestream reducing cigarette wrapping materials and accessory smoke filtration devices may be adapted in the filter sheath of the present invention.

The filter material may be embodied in or bonded to a host material of the sheath which may be a polymeric, ceramic or composite material. In one example, the sheath may be formed of activated carbon porous paper or fabric, which may be light in weight, easy to dispose after use, and is easily biodegradable. Some prior arts on suitable activated carbon filter materials are disclosed in a later part of this section.

The sheath may comprise of at least one layer of materials. In one embodiment, the filter material may be embodied in a single layer of the sheath wall. In another embodiment, the sheath may comprise of an inner layer for filtering particulate matter and vapour and an outer layer for filtering gas components of sidestream smoke. In a third embodiment, the sheath may include a porous outer wrapper, possibly of paper, which may be useful, amongst other functions, to conceal the filter materials used, prevent the dropping of black dust if certain forms of activated carbon materials are used, and to improve the appearance, feel and/or filtration capabilities of the sheath.

The sheath may be of sufficient porosity to air to enable sustenance of combustion of a rod of smokable material when said rod of smokable material is accordingly held within said sheath. In one embodiment, the sheath may be porous or air permeable. In another embodiment, the sheath may be provided with perforations in its wall to allow ambient air to pass therethrough for combustion sustenance. In a third embodiment, the sheath may contain a combustible filler material, said filler material may render said sheath impermeable or of low permeability to ambient air, said porosity for combustion sustenance may be attained through a process whereby combustion of a portion of a rod of smokable material contained within the sheath destroys a corresponding portion of the filler material thereby rendering the corresponding sheath portion porous for sustaining the combustion of a further portion of said rod of smokable material. Once a rod of smokable material within the sheath is lit and an initial portion of the filler material is destroyed in the initial combustion, the sheath may attain porosity necessary for sustaining the combustion of a further portion said rod of smokable material. Said combustion of said rod of smokable material may destroy further portions of the filler material so that porosity may be attained for further sustenance of combustion. The process may continue until substantially all of the rod of smokable material may be consumed. The sheath body may remain substantially unimpaired. The porosity of the sheath may also allow for diffusion of heat through the sheath material into the ambient environment.

The sheath may be adapted to suit a rod of smokable material so that the required draw resistance, smoke quality and quantity, taste, burn characteristics, number of puffs, and so on, may be achieved.

The sheath may be significantly unimpaired by the combustion of a rod of smokable material when the rod of smokable material is accordingly overlaid within said sheath. This feature makes possible significant confinement of combustion products and its proper filtration through the wall of the sheath. A wholesome sheath may provide visual evidence of confinement and thus impart psychological comfort to both smokers and non-smokers. This feature may also allow the sheath to look good and be held in the hand after the smokable materials have been consumed. Such a sheath may also present a convenient outer surface for carrying health warnings, product information, brand captions and the like. In one embodiment, the sheath may be substantially non-combustible at the temperature of a lit cigarette or cigar, or even at higher temperatures. In another embodiment, the sheath may include an outer filter layer and an inner support for holding a rod of smokable material. The inner support may be non-combustible or flame resistant or heat reducing and may comprise of an inner layer, mesh, ribs, pimples, or the like. In a variation, a non-combustible, flame resistant or heat reducing support may be provided over a rod of smokable material, said support together with the rod of smokable material may then be loaded into an outer filter layer of the sheath.

The filter sheath may be suitably rigid so that it may not sag after the smokable materials contained therein have been exhausted in the smoking process. Such rigidity may also allow for a more robust handling of the article. Rigidity may be achieved by making said sheath of a suitably rigid material or by providing a rigid support such as a laminating layer, mesh, ribs or the like. Rigidity may also provide scope for modification of the shape of the article. Suitable modifications of shape may include the flattening of some external surfaces to retard the tendency of the sheath to roll off a slanted surface.

A single sufficiently air permeable, non-combustible, suitably rigid filter layer is a preferred material for making the sheath. Such a layer may be provided in the form of a sheet, membrane, skin or from.

A cigarette or cigar may normally be circumscribed with a wrapper, said wrapper performing a first function of holding together the smokable materials, and a second function of ensuring that ambient air is substantially drawn through the burning end of said rod of smokable material. It may be noted that the filter sheath of the present invention may also hold the smokable materials together. Thus, when a cigarette, cigar or other similar smoking article is to be used with the filter sheath of the present invention, said cigarette, cigar or other similar smoking article may be provided with or without a circumscribing wrapper.

The sheath may have a mouth-side downstream end with respect to the direction of flow of the inhale smoke. Various adaptations may be made to facilitate the loading of smokable material into the sheath. In one example, the sheath may have a downstream open end through which a rod of smokable material may be loaded. In a second example, the sheath may have an upstream open end through which a rod of smokable material may be loaded and/or ignited. In a third example, the sheath may be formed by wrapping the sheath material over a rod of smokable material. In a fourth example, the inside of the sheath may be lined with a wrapper. Smokable materials may subsequently be loaded into said wrapper.

The sheath may have an orifice for allowing ignition of a rod of smokable material to be therein contained. Preferably said orifice may be provided to correspond with the upstream portion of said rod of smokable material. Said orifice may be provided with a door which may be closed after the smokable material in the sheath has been lit. Suitable doors may include a flap door, a sliding door, a swing door, a detachable cap, a slidable overlying sleeve, or the like.

In one embodiment, the sheath may have a lighting surface adapted for allowing a flame or heat source placed near or on said lighting surface to ignite a rod of smokable material contained within the sheath. Said lighting surface may be made of a non-combustible or flame resistant material. The lighting surface may suitably be provided at the upstream end portion of the sheath. It is also preferable that the lighting surface be provided with a smoke filtration capability so that any sidestream smoke passing through said lighting surface may also be filtered before release into the surroundings. Said smoke filtration capability may reside in the non-combustible or flame resistant material or in another material cooperating with said non-combustible or flame resistant material. The lighting surface may allow a smoker to light up a smoking article contained within a filter sheath without having to bother about opening or closing an ignition opening. The lighting surface may hold in the ashes generated by the burning of smokable materials. Suitable materials for making the lighting surface include a non-combustible or flame resistant fabric, paper, metalic, plastic or ceramic mesh, adapted to have pores of sufficient size and/or heat conductivity to allow smokable materials held within the upstream end of the sheath to be ignited.

The portion about the downstream end of the filter sheath may be circumscribed with tipping paper.

The sheath may be provided with at least one transparent or translucent portion for allowing a smoker to view a rod of smokable material therein contained so that the stage of consumption of said rod of smokable material may be known.

The filter sheath according to this invention may overlay a rod of smokable material such that the mainstream smoke outlet of said rod of smokable material may correspond with an open end of said sheath, whereby one or more of such filter sheath overlaying a rod of smokable material may be provided in a pre-packed form. Such a filter sheath with a rod of smokable material in a pre-packed form may easily be prepared in large quantities in a mass-production operation and may relieve users of the need for personal intervention to load a rod of smokable material into a filter sheath.

The filter sheath and the filter sleeve may be provided together wherein one open end of said sheath may be in flow communication with the downstream portion of said filter sleeve. Preferably said filter sheath and filter sleeve are of similar circumferential dimensions and be substantially coaxially aligned in flow communication.

A comprehensive filter smoking article may comprise of a filter sheath according to any one or more in combination of the features elaborated above and a filter sleeve according to any one or more in combination of the features elaborated above, wherein said filter sheath may overlay a rod of smokable material whereby the mainstream smoke outlet of said rod of smokable material may be in flow communication with the downstream portion of said filter sleeve. One or more of such comprehensive filter smoking article may be provided in a pre-packed form.

The filter sleeve may communicate with the rod of smokable material and/or filter sheath in any conventional manner. A wrapper may circumscribe the portion about the joint of the filter sleeve with said rod of smokable material or filter sheath. Said wrapper may indicate a convenient place for a smoker to hold the article in the act of smoking. In one embodiment, the filter sheath and filter sleeve may be of similar circumferential dimensions and coaxially aligned in communication.

The comprehensive filter smoking article may easily be made in large quantities in a mass production operation. The dimensions and shape of a comprehensive filter smoking article may be adapted to suit a rod of smoking material. Used with a cigarette, for example, a comprehensive filter article may have a total length of about 122 mm, external diameter of about 8 mm, and an upstream inhalation-exhalation port of about 5 mm diameter, making it extremely easy to blow into. With such dimensions, the article may somewhat resemble a conventional ball-point pen without its cover and cone tip.

DETAILED DESCRIPTION OF THE INVENTION

In order that the present invention may be more readily understood, the following descriptions are given, by way of example, of seven specific embodiments made in accordance with the present invention. These embodiments are set forth for purposes of illustration only and are not to be construed as limitations on the present invention. Numerous combinations of technical features, modifications, additions and deletions may be made without departure from the spirit and scope of this invention.

Reference will be made to the accompanying drawings in which.

Figure 1:
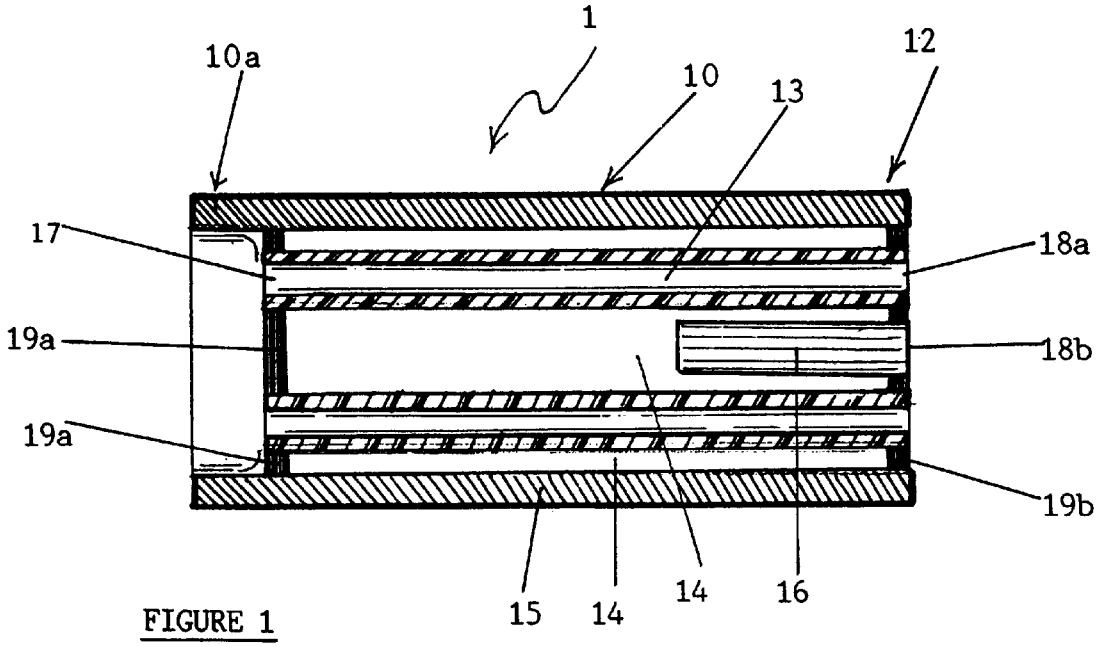
FIG. 1 is an elongated sectional view of one embodiment of a filter sleeve for filtering exhale smoke according to this invention.
Figure 1A:
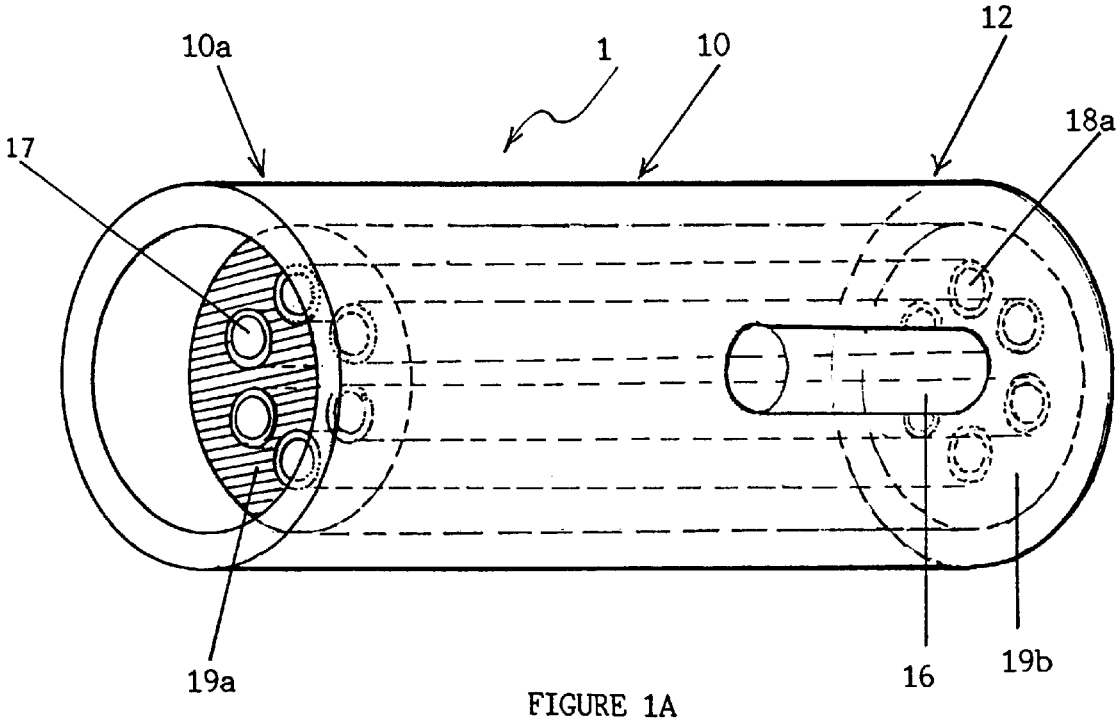
FIG. 1A is a three dimensional outline view.

FIG. 1 is an elongated sectional view of one embodiment of a filter sleeve for filtering exhale smoke according to this invention. FIG. 1A is a three dimensional outline view of said filter sleeve. The filter sleeve (1) comprises of a cylindrical sleeve (10), its elongate hollow closed toward the downstream end and at the upstream end by transverse walls (19*a*, 19*b*), preserving a slight protrusion (10*a*) of the sleeve (10) at the downstream end. Inlets (17) are provided along the periphery of the downstream transverse wall (19*a*) for receiving inhale smoke from a smoking article. Said inlets (17) are connected in flow communication to outlets (18*a*) provided along the periphery of the upstream transverse wall (19*b*) by a plurality of tubular inhalation flow paths (13), said inhalation flow paths (13) run longitudinally inside the elongate hollow of the sleeve (10). In addition to channelling inhale smoke, said inhalation flow paths (13) may also provide support for the wall of the sleeve (10). An upstream inlet (18*b*) is provided in the centre of the upstream transverse wall (19*b*) for receiving exhale smoke, wherein said exhale smoke may flow along an exhalation flow path (14) defined by the elongate hollow of the sleeve (10), said exhale smoke may be filtered through filter materials (15) embodied in the wall of the sleeve (10). Filtered air is discharged from said filter materials (15) directly into the ambient environment. A one-way valve (16) is provided along the exhalation flow path (14) immediately downstream of the upstream inlet (18*b*), said one-way valve (16) is for checking the flow of ambient air into and through the exhalation flow path (14) when the upstream portion (12) of the sleeve (10) is inhaled. Said one-way valve (16) is held inside the exhalation flow path (14) by the upstream transverse wall (19*b*). Said valve (16) may be adapted from an existing valve system.

Figure 2:
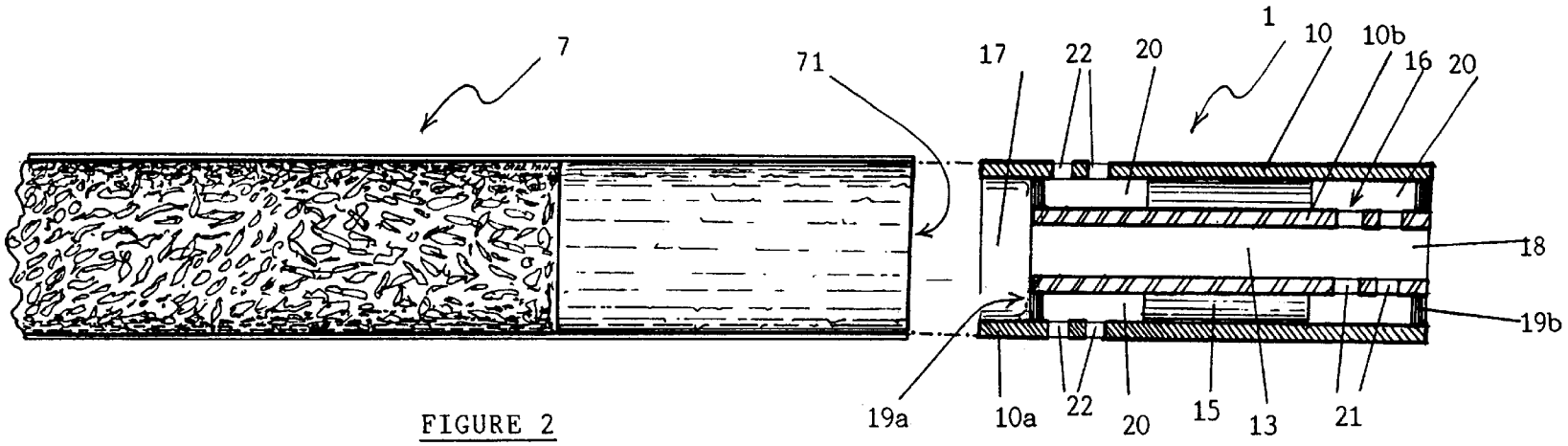
FIG. 2 is an elongated sectional view of a second embodiment of a filter sleeve according to this invention.
Figure 2A:
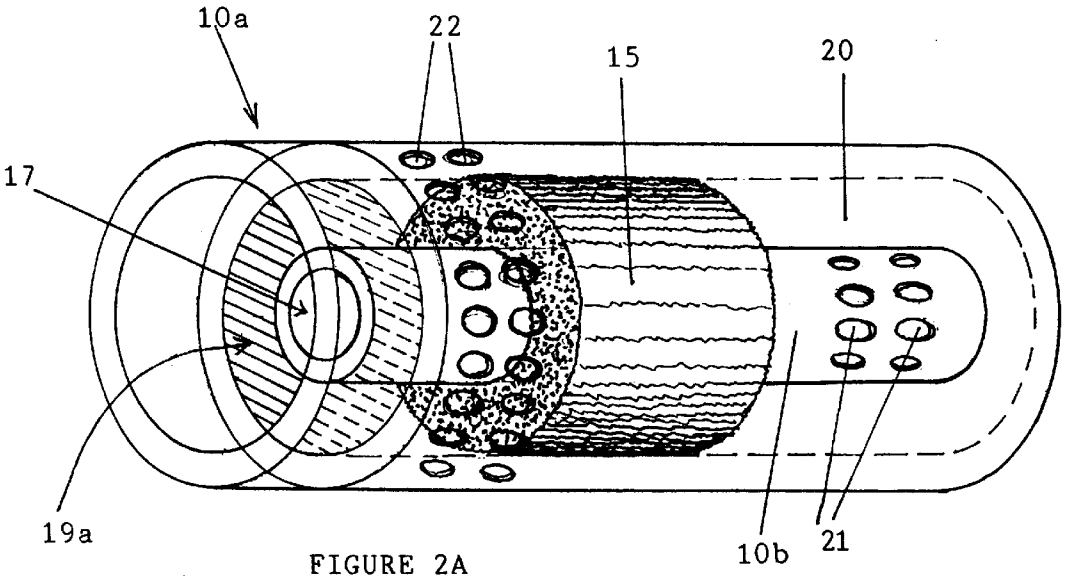
FIG. 2A is a three dimensional outline view.

FIG. 2 is an elongated sectional view of a second embodiment of a filter sleeve according to this invention. FIG. 2A is a three dimensional outline view of said filter sleeve. The filter sleeve (1) comprises of an inner sleeve (10*b*) fitted coaxially into the elongate hollow of a longer outer sleeve (10). Said two sleeves are flushed at the upstream end and the annular space (20) between the two sleeves is sealed at both ends by transverse ring-shaped walls (19*a,* 19*b*), providing a slight protrusion (10*a*) of the outer sleeve (10) at the downstream end. Said protrusion (10*a*) may be placed in abutment with the mainstream smoke outlet (71) of a smoking article (7) and the joint portion wrapped with wrapping paper (not shown). The downstream end of the sleeve (10) forms an inlet (17) for receiving inhale smoke from the smoking article (7), said inhale smoke may be drawn through an inhalation flow path (13) defined by the elongate hollow of the inner sleeve (10*b*) and inhaled through an upstream outlet-cum-inlet (18) defined by the upstream open end of said inner sleeve (10*b*). Said outlet-cum-inlet (18) is also provided for receiving exhale smoke wherein an exhalation flow path extending downstream from said outlet-cum-inlet (18) channels said exhale smoke into openings (21) in a first upstream section of the inner sleeve wall (10*b*) and through a one-way valve system (16) provided in a first upstream section of the annular space (20). Said exhale smoke is filtered through filter means (15) provided in a second middle section of said annular space (20). Filtered air from the filter means (15) may be discharged via a third upstream section of the annular space (20) and out into the ambient environment through openings (22) in the outer sleeve wall.

Figure 3:
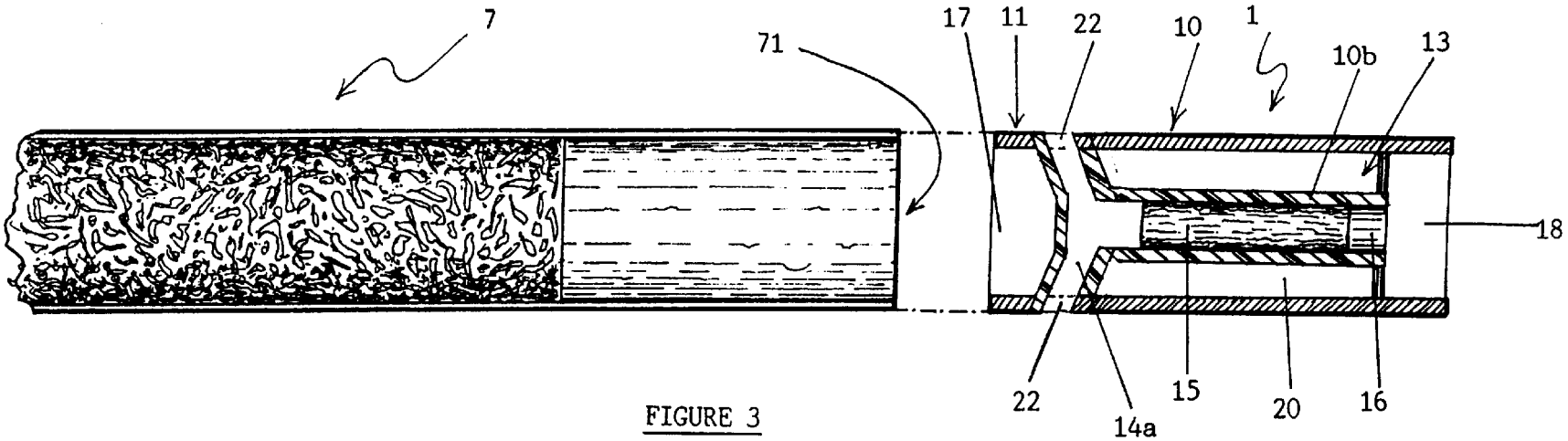
FIG. 3 is an elongated sectional view of a third embodiment of a filter sleeve according to this invention.
Figure 3A:
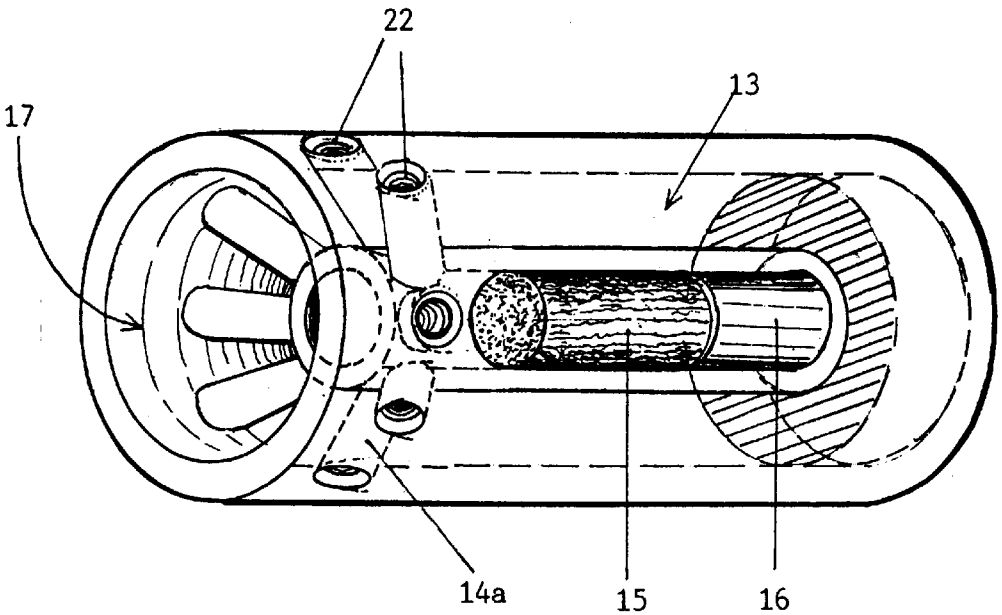
FIG. 3A is a three dimensional outline view.

FIG. 3 is an elongated sectional view of a third embodiment of a filter sleeve according to this invention. FIG. 3A is a three dimensional outline view of said filter sleeve. The filter sleeve (1) comprises of an outer sleeve (10) having a downstream end inlet (17) adapted for receiving inhale smoke from the mainstream smoke outlet (71) of a smoking article (7). An upstream end outlet-cum-inlet (18) is provided for the inhalation of said inhale smoke channelled through an inhalation flow path (13) defined substantially by the elongate hollow of the sleeve (10). Said upstream outlet-cum-inlet (18) is also provided for receiving exhale smoke. An inner sleeve (10*b*) is fitted coaxially into said outer sleeve (10) so that an annular space (20) is provided between the outside wall of the inner sleeve (10*b*) and the inside wall of the outer sleeve (10). Said inner sleeve (10*b*) has a closed downstream end and is held in place by radially extending tubes (14*a*) connecting the downstream section of the inner sleeve (10*b*) to openings (22) in the wall of the outer sleeve (10). The elongate hollow of the inner sleeve (10*b*) and tubes (14*a*) form the exhalation flow path of the sleeve (10). Filter means (15) is provided in a middle section of the inner sleeve (10*b*). A one-way valve system (16) fitted into the upstream opening of the inner sleeve (10*b*) allows exhale smoke to reach the filter means (15), but substantially prevents ambient air from being drawn into the exhalation flow path in a reverse flow when the outlet-cum-inlet (18) is inhaled. The filter sleeve (1) may be attached to a smoking article (7) by placing the downstream portion (11) in end to end abutment with the mainstream smoke outlet (71) of said smoking article (7) and circumscribing the joint portion with wrapping paper (not shown).

Figure 4:
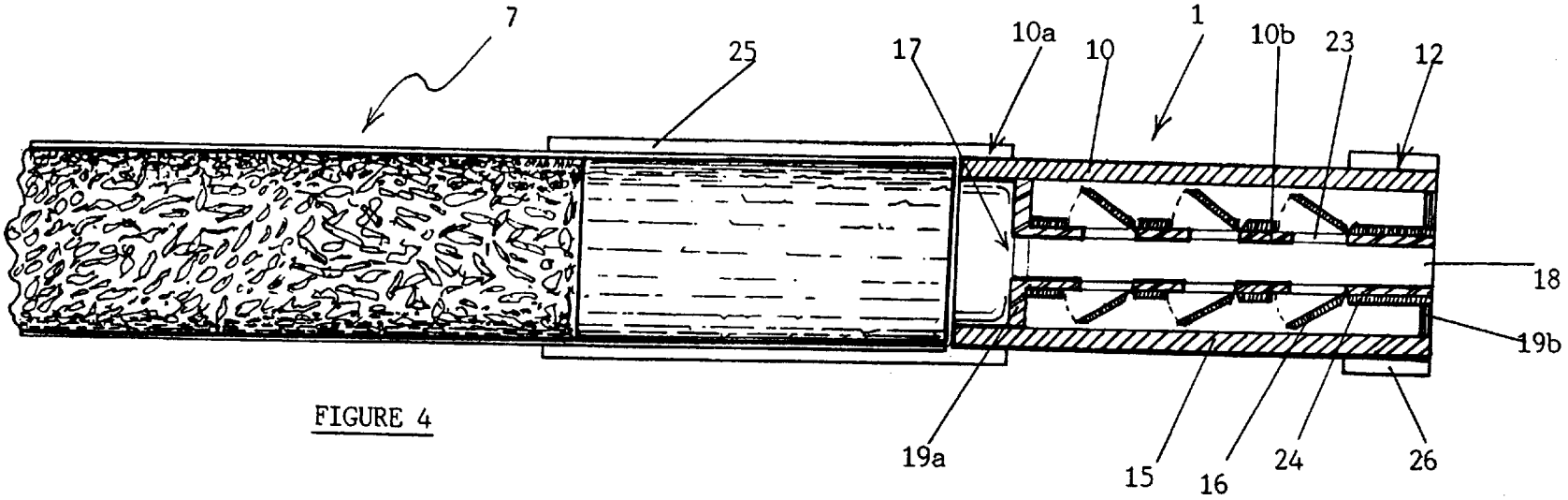
FIG. 4 is an elongated sectional view of one embodiment of a filter sleeve with a smoking article in a pre-packed form according to this invention.

FIG. 4 is an elongated sectional view of one embodiment of a filter sleeve in communication with a smoking article according to this invention. The filter sleeve (1) comprises of an outer sleeve (10) made of activated carbon porous paper. A shorter inner sleeve (10*b*) is fitted coaxially into the elongate hollow of said outer sleeve (10). The upstream ends of both sleeves are flushed and the annular space between the outside wall of the inner sleeve (10*b*) and the inside wall of the outer sleeve (10) is sealed at both ends by transverse ring-shaped walls (19*a,* 19*b*), providing a slight protrusion (10*a*) of the outer sleeve (10) at the downstream end. An inlet (17) is defined in the downstream end of the inner sleeve (10*b*) for receiving inhale smoke and an outlet-cum-inlet (18) is defined in the upstream end of said inner sleeve (10*b*) for the drawing of said inhale smoke and receiving of exhale smoke. The inner sleeve (10*b*) is provided with a plurality of apertures (23) in its wall. The outer surface of said inner sleeve (10*b*) is overlaid with a thin film (24), said film (24) is punched to achieve flaps (16) corresponding to the apertures (23). Said flaps (16) are resiliently biased to close said apertures (23) so that when smoke is exhaled into the outlet-cum-inlet (18), said smoke may move along the elongate hollow of said inner sleeve (10*b*), whereby said flaps (16) move outwardly toward the outer sleeve (10) to open said apertures (23), thereby allowing exhale smoke to access the filter materials (15) embodied in the wall of the outer sleeve (10) through said apertures (23). The downstream protrusion (10*a*) of the outer sleeve (10) abuts the mainstream smoke outlet of a smoking article (7), and the joint portion is circumscribed with a wrapper (25). The upstream portion (12) of said outer sleeve (10) is circumscribed with tipping paper (26).

The inner sleeve may suitably be made with metallic, ceramic, polymeric or composite materials. Low porosity or air impermeable paper or plastic may be particularly suitable. Suitable materials for making the film and flaps include paper, plastic, rubber or the like.

The following are some modifications which may be made to this embodiment:

(a) the adaptation of diaphragms as valve members instead of flaps.

(b) the location of apertures only toward the upstream end of the inner sleeve wherein the valve member may comprise of a single cylindrical coaxial flap having its upstream end portion sealed to the outside wall of the inner sleeve at a point upstream of the apertures. A filter plug may be provided in the downstream section of the elongate hollow of the inner sleeve for filtering inhale smoke.

(c) the location of apertures only toward the upstream end of the inner sleeve wherein a movable reed or ball valve member may be provided inside the hollow of the inner sleeve so that it may be drawn to close the apertures when the article is inhaled. Inhale smoke may be drawn through pores in the valve member wherein said valve member may also be adapted as a filter plug for filtering said inhale smoke. In a further variation, inhale smoke may be drawn through detour flues linking a downstream section of the inner sleeve to an upstream section of said inner sleeve.

(d) the location of apertures only toward the downstream end of the inner sleeve wherein the valve member may comprise of a cylindrical coaxial flap having its downstream end portion sealed to the inside wall of the outer sleeve.

(e) the use of an inner sleeve having a smaller external diameter toward the downstream end wherein clearance space for valve movement and exhale smoke may be improved toward said downstream end.

(f) the use of an inner sleeve having some flat outer surfaces for easier opening and closing of valve flaps.

(g) the sitting of valve flaps inside craters, grooves or recesses in the outside wall of the inner sleeve to provide more height clearance for said valve flaps to open and close freely.

Figure 5:
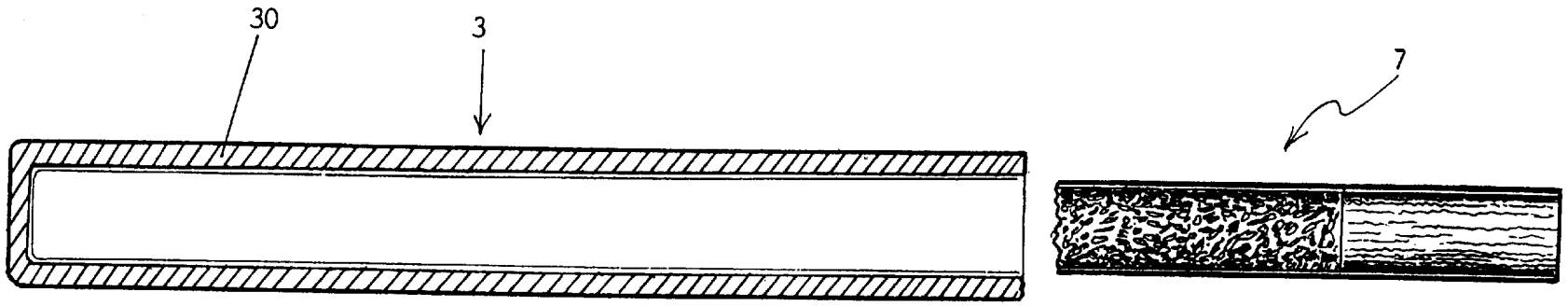
FIG. 5 is an elongated sectional view of one embodiment of a filter sheath according to this invention.

FIG. 5 is an elongated sectional view of one embodiment of a filter sheath according to this invention. The filter sheath (3) comprises of a sheath (30) made of non-combustible activated carbon porous paper that is of sufficient porosity to air but is significantly impermeable to sidestream smoke, said sheath (30) is adapted for overlaying the sidestream smoke emission surfaces of a rod of smokable material (7).

Figure 6:
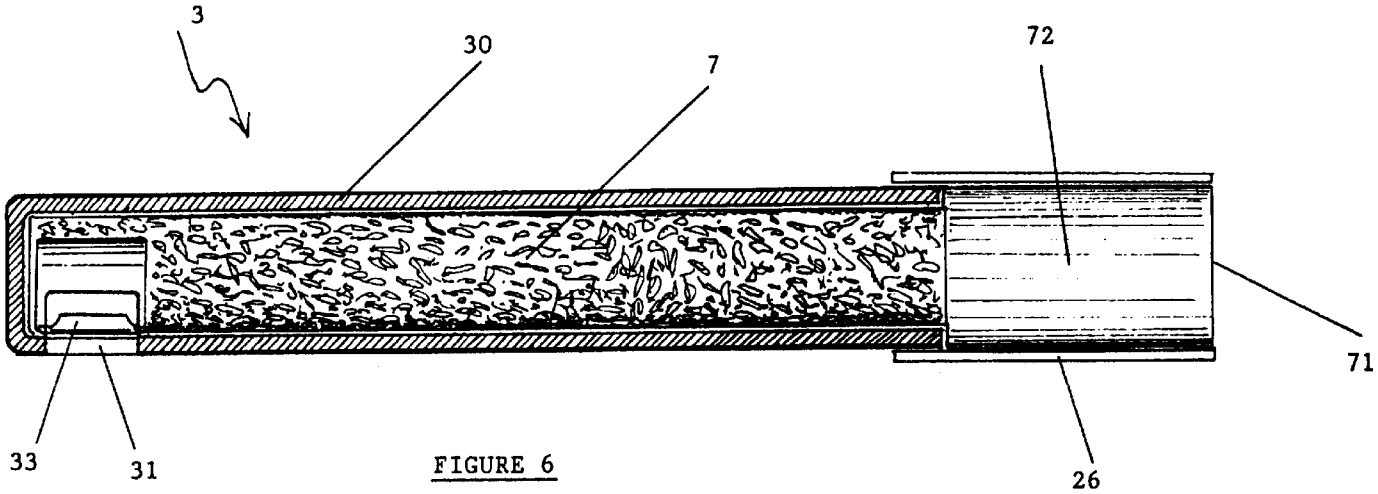
FIG. 6 is an elongated sectional view of one embodiment of a filter sheath with a rod of smokable material in a pre-packed form according to this invention.
Figure 6A:
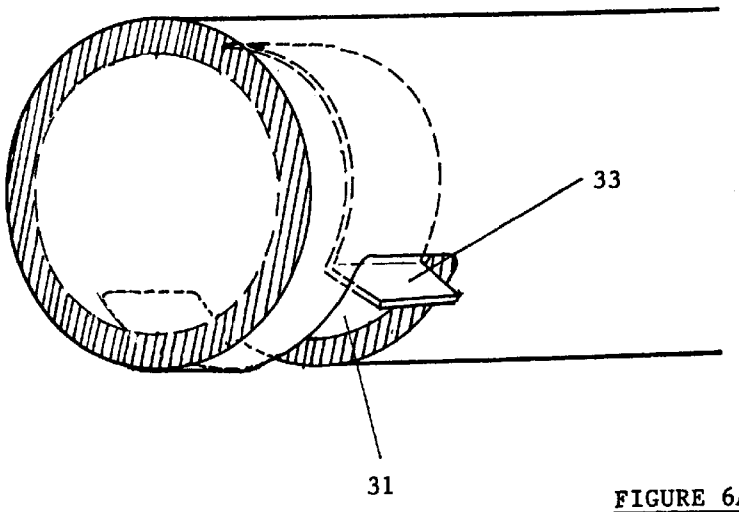
FIG. 6A is a three dimensional outline view of the orifice and sliding door of said filter sheath.

FIG. 6 is an elongated sectional view of one embodiment of a filter sheath laid over a rod of smokable material in pre-packed form according to this invention. FIG. 6A is a three dimensional outline view of the orifice and sliding door of said filter sheath. The filter sheath (3) comprises of a sheath (30) made of non-combustible activated carbon porous paper that is of sufficient porosity to air but is significantly impermeable to sidestream smoke. Said sheath (30) is laid over the sidestream smoke emission surfaces of a rod of smokable material (7) so that the mainstream smoke outlet (71) of said rod of smokable material (7) corresponds with the downstream open end of the sheath (30). Said sheath (30) has an orifice (31) with a sliding door (33) toward the upstream end for allowing the ignition of said rod of smokable material (7). The portion about the joint of the sheath (30) with the filter-tip (72) of said rod of smokable material (7) is circumscribed with tipping paper (26).

Figure 7:
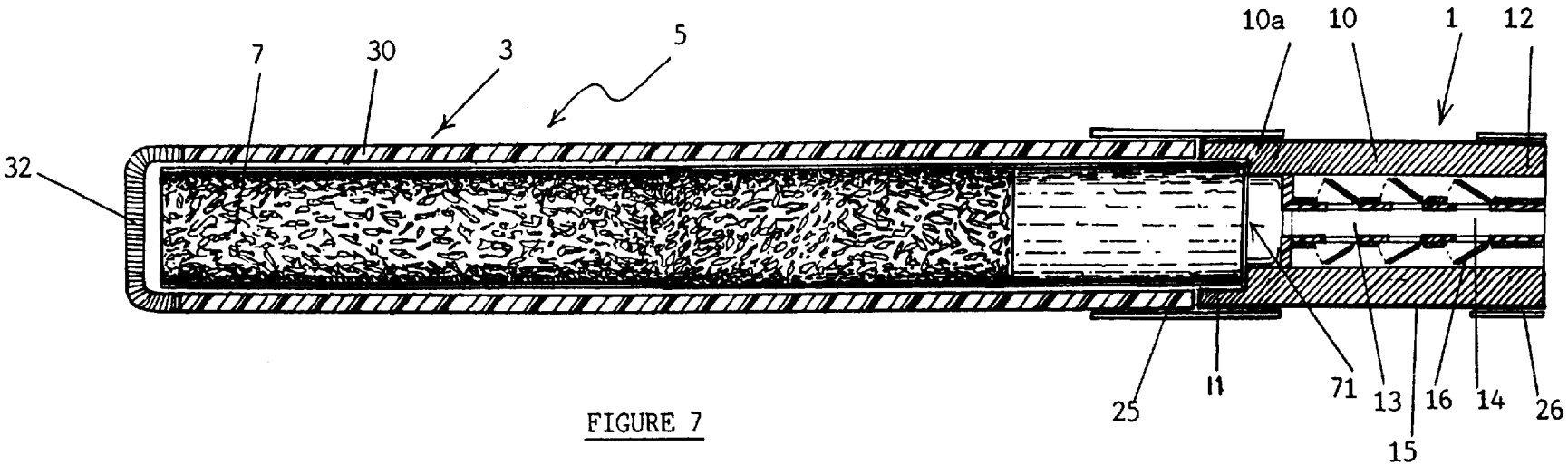
FIG. 7 is an elongated sectional view of one embodiment of a comprehensive filter smoking article according to this invention.

FIG. 7 is an elongated sectional view of one embodiment of a comprehensive filter smoking article according to this invention. The comprehensive filter smoking article (5) comprises of a non-combustible, sufficiently porous activated carbon sheath (30), said sheath (30) overlays a rod of smokable material (7) so that the mainstream smoke outlet (71) of said rod of smokable material (7) protrudes out of the mouth-side downstream open end of the sheath (30). Said downstream open end of the sheath (30) abuts the downstream protrusion **(10*a*) of the filter sleeve (1) described in FIG. 4 so that the mainstream smoke outlet (71) of the rod of smokable material (7) mates into the downstream inlet of the sleeve (10). The joint portion of the sheath (30) with the downstream protrusion (10*a*) is circumscribed with a wrapper (25). The upstream portion (12) of said sleeve (10) is circumscribed with tipping paper (26). Further, the sheath (30) is provided with a lighting surface (32) wherein an upstream open end of the sheath (30) is covered with a mesh made of a non-combustible filter material, said mesh is adapted for allowing a flame or heat source placed near or on said lighting surface (32) to ignite said rod of smokable material (7)**.

The following tests were conducted to investigate various aspects of this invention:

a) To estimate the feasibility of a probable type of valve system, a 42 mm inner sleeve was cut from a drinking straw having an internal diameter of 5 mm. A plurality of apertures were made in the wall of said inner sleeve. Flaps made from thin plastic cuttings were glued to the side of each aperture. The inner sleeve was then fitted coaxially into the elongate hollow of an outer sleeve cut from a drinking straw having an internal diameter 8 mm. Closing one end of the inner sleeve with a finger, exhalation was executed into the opposite open end of said inner sleeve. No perceptible resistance to exhalation was felt. During inhalation however, a clear resistance was felt as the flaps closed over the apertures.

b) To estimate the resistance to exhalation of a probable type of filter material, a sleeve of 42 mm length was cut from a drinking straw of 22 mm external circumference. The downstream end of said sleeve was closed. Four strips of 27 mm length each were cut from the sleeve wall immediately adjacent the downstream closed end to create outlets. A double layer of cotton fabric was wound around said outlets. The remaining 15 mm opposite end of the sleeve was retained for insertion into the mouth. Said fabric material showed no perceptible resistance when exhalation was executed into the upstream open end of the sleeve.

In use, a sleeve of 42 mm length, when added to a rod of smokable material, is likely to be acceptable to smokers as the article or a pack of it can still be put neatly into a shirt pocket. If a sleeve of about 42 mm length, for example, is added to a cigarette of about 22 mm external diameter, the shape, thickness and length of said cigarette may somewhat resemble a conventional ball-point pen without its cover and cone tip.

c) In another test of resistance to exhalation, two short pieces of drinking straw of 22 mm circumference each were placed coaxially 20 mm apart to form a straight but broken line. Two layers of cotton fabric were used to circumscribe the ends of the two straws facing each other so that the cotton fabric formed a cylindrical hollow joining the elongate hollows of the two straws. The downstream open end of one straw was closed with a finger and exhalation was executed into the opposite upstream open end of the other straw. No perceptible resistance to exhalation was felt.

d) In a test of porosity to air and combustion sustenance of a probable type of sheath material, a lit cigarette was circumscribed with three layers of cotton fabric so that the cotton fabric protruded beyond the lit end of the cigarette. The protruding portion of the cotton fabric was held closed. The cigarette continued burning and eventually burned through the cotton fabric, demonstrating that porosity necessary for the sustenance of tobacco combustion is relatively easy to achieve. This observation is applied directly in this invention by overlaying at least a significant portion of the sidestream releasing surfaces of a rod of smokable material with a sheath that is sufficiently porous to air. This application makes possible the elimination of the cylindrical air space between a rod of smokable material and a filter sheath, thus considerably reducing the thickness associated with sidestream filtration. Combustion products may be confined. The use of a porous sheath capable of sustaining combustion also makes redundant the use of a motorized impeller or fan. By adjusting the degree of air permeability or porosity of the sheath, said sheath may be adapted to enable minimal sustenance of combustion of smokable material at a reduced rate of sidestream smoke production.

There are many existing filter materials that may be adapted for use in the present invention. Also known are methods for making flame resistant fibers, yarn and sheets which may be adapted as a flame resistant support of the present invention. Further, there are various methods for imparting flame resistance to sheet materials. Variations in colour, texture or porosity of filter materials may be achieved using methods well known in paper or fabric making.

The following materials may possibly be adapted for use as the filter material of the filter sleeve and/or filter sheath of the present invention:

a) U.S. Pat. No. 5,482,906 disclosed an adsorption material comprising milled activated carbon fiber together with fibrils of a polytetrafluoroethylene resin. The adsorption material has high bulk density and mechanical strength, forms less black dust, retains activity essential to activated carbon fibers, provides less pressure drop, good permeability to liquid or gas, and is easily formed into various shapes. The material can be formed into a sheet preferably from 1 to 0.1 mm thick, but it may be reduced to as little as 0.02 mm.

b) U.S. Pat. No. 5,482,773 disclosed activated carbon-loaded polymeric fibrids having high surface area and adsorption activity. Even though the carbon is completely encapsulated by the polymer, the microporous surface area of the fibrids is substantially greater than that of non-loaded fibrids. Also encompassed are wet-laid composite sheet structures comprising papers of such fibrids with or without short staple fibers, or mats of such fibrids and fiber fluff and composite sheet structures formed by hydrolacing such fibrids with synthetic fibers. This invention also provides non-shedding, fibrous sheet structures containing carbon-loaded fibrids which are suitable for separating gaseous impurities from air and dissolved impurities from water and other liquids. High levels of carbon can be incorporated into the structures with a wide range of densities and air permeability without the need for adhesives. One can prepare papers with air permeabilities ranging from 0.3 to 30 mm3/min/m2.

c) U.S. Pat. No. 4,904,343 disclosed a toxic vapour adsorptive non-woven activated carbon fabric.

d) U.S. Pat. No. 4,565,727 disclosed a non-woven activated carbon fabric of high sorptive capacity and high porosity to fluid flow, produced via the wet-laying process and having a thickness of at least 0.005 preferably at least 0.01 inch.

e) U.S. Pat. No. 4,520,623 disclosed an activated carbon fiber spun yarn which may subsequently be woven into a fabric.

f) U.S. Pat. No. 4,495,030 disclosed an active carbon filter paper excellent for removal of aerosols, particulates and toxic vapors, having high porosity to fluid flow at very low pressure drops, having thickness of at least 0.005 preferably at least 0.01 inch.

g) U.S. Pat. No. 4,401,588 disclosed an activated carbon fabric made directly from aramid fabric in a single activation step.

h) U.S. Pat. No. 4,358,504 disclosed a flame retardant activated carbon web. Treating an activated carbon sheet with a selected flame retardant composition consisting essentially of a basic ammonium phosphate, preferably diammonium phosphate provides the beneficial flame retardant character so that no after-glow is exhibited and the adsorption characteristics of the sheet is not substantially reduced. The flame retardant can be applied over a wide weight and porosity range and can be used with a large number of different types of activated carbon materials. Due to its flame retardant properties, such a web may be particularly suitable for use as the filtering material of the filter sheath of the present invention.

i) U.S. Pat. No. 4,067,210 disclosed a warp knit fabric containing highly activated carbon yarn produced on commercially available fabric forming machines.

j) U.S. Pat. No. 3,769,144 disclosed a quilted fabric containing high surface area carbon fibers.

k) U.S. Pat. No. 3,149,023 disclosed a carbon filled sheet having high strength, high absorptive and/or adsorptive properties and being free from rub-off, flaking and smudging.

The following patents disclosed materials that may be adapted as a non-combustible or flame resistant support for the filter sheath. Said materials may also be adapted for use as a non-combustible or flame resistant lighting surface:

a) U.S. Pat. No. 3,744,534 disclosed a flame resistant woven fabric of activated carbon yarns in combination with aromatic polymide yarns.

b) U.S. Pat. No. 3,639,140 disclosed a process for carbonized cellulose fiber by treating with a specific strength increasing agent or a flame resistance improving agent.

c) U.S. Pat. No. 3,576,769 disclosed a semicarbonization of thermally stable aromatic polymers resulting in fibers or fabric that are essentially non-flammable and thermally stable.

d) U.S. Pat. No. 3,556,712 disclosed a method of making a high tenacity and high flame-proof carbon fiber from a cellulosic viscose rayon wherein a modified viscose rayon fiber having a high degree of polymerization is used as a starting cellulosic material.

e) U.S. Pat. No. 3,235,323 disclosed a heat-resistant black fibers and fabrics derived from rayon; a woven sheet of this material can hold a half-pound of molten steel (temperature of about 2700° F.) without burning or disintegrating.

The present invention may make possible the following advantages:

The filter sleeve:

a) The filter sleeve may be slim and lightweight and offer great convenience in use.

b) A large exhale smoke receiving inlet and exhalation flow path may provide for effortless exhalation.

c) The wall of the sleeve may provide a huge surface for receiving and filtering exhale smoke, thereby further minimizing the resistance to exhalation.

d) The mouth-end of the filter sleeve may provide for hassle-free inhalation and exhalation.

e) The mouth-to-filter-to-environment distance may be reduced, thereby saving space and further reducing resistance to exhalation.

f) The filter sleeve may be easily and inexpensively manufactured.

g) A disposable pre-packed form of the filter sleeve integrally in communication with a smoking article may easily be produced in large quantities in a mass production facility.

h) A filter sleeve of similar circumferential dimensions as a cigarette or cigar, and provided in substantial coaxial alignment in communication with said cigarette or cigar, may be packed elegantly and economically into a minimally altered cigarette or cigar box.

The filter sheath:

a) The filter sheath is slim and lightweight.

b) It is easy and inexpensive to manufacture.

c) It may reduce sidestream pollution more effectively than wrapping papers and less smoke cigarettes of the prior art.

d) A sheath substantially unimpaired by combustion is psychologically reassuring.

e) The sheath may remain pleasant to both sight and smell during and after use.

f) Confinement of combustion may further reduce the risk of accidental fires and bodily hurt.

g) It is easier and more convenient to use than existing accessory cigarette smoke filtration devices.

The filter sleeve and/or filter sheath with a rod of smokable material in a pre-packed form:

a) The article may be less polluting than conventional smoking articles such as cigarettes, cigars or the like.

b) It may provide for effortless exhalation.

c) It may be slim and lightweight and offer great convenience in use.

d) It is easy and inexpensive to manufacture.

e) It is advantageously visible in use and may be comforting and psychologically reassuring to both smokers and non-smokers.

f) It is suitable for use in numerous social situations, yet allows smokers to exhale in the conventional manner when there are no nearby persons.

g) It is suitable for mass production.

h) It may filter smoke without substantially changing the taste and other characteristics of the inhale smoke.

i) It may eliminate the need for loading and unloading of tobacco, filter materials, monitoring and maintenance.

j) A disposable form of the article may be appealing to users.

k) It may provide a large external surface which may carry health warnings, captions and the like, and be safely held throughout the smoking process.

l) The article's rigidity may reduce crumpling and allow for more robust handling.

m) After use, the exhausted article may remain pleasant to the sight and be dropped into a shirt pocket for temporary storage if there is no nearby disposal bin.

What I claim is:

1. A filter sleeve for filtering exhale smoke comprising a sleeve with a downstream portion adapted for communicating with a smoking article to receive inhale smoke from said smoking article;

an upstream portion adapted for inhalation of said inhale smoke and for receiving of exhale smoke;

at least one inhalation flow path from said downstream portion to said upstream portion, said inhalation flow path is provided for channeling of said inhale smoke for inhalation through said upstream portion;

at least one exhalation flow path extending from said upstream portion to at least one exit into the ambient environment whereby exhale smoke received into said upstream portion is channeled through said exhalation flow path for filtration and discharge of filtered air into the ambient environment, wherein at least a significant portion of one flow path runs coaxially and within the other flow path, and wherein the exhalation flow path exits through a wall of the sleeve;

filter means provided along at least one exhalation flow path, said filter means is provided for said filtration of received exhale smoke to produce filtered air, said filter means is of such efficiency as to render said filtered air substantially smoke-free;

wherein the discharge of said filtered air into the ambient environment is significantly unimpeded by said smoking article when said smoking article is in flow communication with said downstream portion of the sleeve; and means for substantially checking the reverse flow of ambient air through said exhalation path, said means allow a considerably high rate of exhale flow to pass through said exhalation flow path.

2. A filter sleeve according to claim 1 wherein at least one downstream inlet is provided at said downstream portion, said downstream inlet is provided for the receiving of said inhale smoke into said inhalation flow path.

3. A filter sleeve according to claim 1 wherein at least one upstream outlet is provided at said upstream portion whereby inhale smoke channelled through said inhalation flow path can be inhaled through said upstream outlet.

4. A filter sleeve according to claim 1 wherein at least one upstream inlet is provided at said upstream portion, said upstream inlet is provided for said receiving of exhale smoke into said upstream portion.

5. A filter sleeve according to claim 1 wherein at least one upstream outlet is provided at said upstream portion for inhalation of inhale smoke channelled through said inhalation flow path and at least one upstream inlet is provided at said upstream portion for receiving of exhale smoke into said upstream portion whereby said upstream outlet and said upstream inlet coincide.

6. A filter sleeve according to claim 1 wherein said inhalation flow path and said exhalation flow path coincide in part or in whole.

7. A filter sleeve according to claim 1 wherein said filter means comprises of filter materials embodied in at least a portion of the wall of the sleeve.

8. A filter sleeve according to claim 7 wherein a valve assembly is provided along the inhalation flow path or outside the sleeve, said valve assembly is adapted for cooperating with said inhalation flow path to allow said inhale smoke to pass through said inhalation flow path but substantially prevent exhale flow from passing through said inhalation flow path.

9. A filter sleeve according to claim 1 wherein said filter means allows a considerably high rate of exhale flow to pass therethrough.

10. A filter sleeve according to claim 1 wherein said filter means is practically non-replaceable.

11. A filter sleeve according to claim 1 wherein said discharge of filtered air into the ambient environment is provided through the wall of the sleeve and/or through the downstream end of the sleeve.

12. A filter sleeve according to claim 1 wherein said means comprises of a valve system provided along said exhalation flow path.

13. A filter sleeve according to claim 1 wherein the means for substantially checking the reverse flow of ambient air through said exhalation flow path comprises a valve system which is in flow communication with said exhalation flow path.

14. A filter sleeve according to claim 1 wherein said means resides in the special construction of the upstream portion of the sleeve whereby an upstream outlet in communication with said inhalation flow path is sufficiently distinguished from an upstream inlet in communication with said exhalation flow path so that said upstream outlet may be drawn without substantially drawing on said upstream inlet.

15. A filter sleeve according to claim 1 wherein a filter plug is provided along the inhalation flow path, said filter plug is provided for filtering inhale smoke.

16. A filter sleeve according to claim 1 wherein said sleeve has an external circumference not significantly larger than that of the rod of said smoking article.

17. A filter sleeve according to claim 1 wherein said sleeve is adapted for substantial coaxial alignment in communication with the rod of said smoking article.

18. A filter sleeve according to claim 1 wherein flow communication between the downstream portion and said smoking article, is provided through a tubular intermediary linking said downstream portion to the mainstream smoke outlet of said smoking article.

19. A filter sleeve according to claim 1 wherein the downstream portion of said sleeve is in flow communication with the mainstream smoke outlet of said smoking article, whereby one or more of such filter sleeve with a smoking article is in a pre-packed form.

20. A filter sleeve according to claim 1, further comprising a filter sheath which overlays a rod of smokable material whereby the mainstream smoke outlet of said rod of smokable material is in flow communication with the downstream portion of said filter sleeve;

wherein, said filter sleeve in combination with said filter sheath forms a comprehensive filter smoking article.

21. The filter sleeve of claim 1, wherein the inhalation flow path and the exhalation flow path are concentric with one another.

22. The filter sleeve of claim 21, wherein the inhalation flow path and the exhalation flow path comprise distinct separate pathways.

23. The filter sleeve of claim 1, wherein the inhalation flow path and the exhalation flow path coincide with one another.

* * * * *